US005092622A

United States Patent [19]

Wladar et al.

[11] Patent Number: 5,092,622

[45] Date of Patent: Mar. 3, 1992

[54] SOLE-SUPPORT DEVICE FOR SKI BINDING

[75] Inventors: Helmut Wladar, Vienna; Hubert Wuerthner, Hainburg/Donau; Klaus Hoelzl, Vienna; Andreas Janisch, Oeyenhausen; Stefan Vomela, Vienna, all of Austria

[73] Assignee: TMC Corporation, Baar, Switzerland

[21] Appl. No.: 511,055

[22] Filed: Apr. 19, 1990

[30] Foreign Application Priority Data

| | | | |
|---|---|---|---|
| Apr. 21, 1989 | [AT] | Austria | 955/89 |
| Nov. 24, 1989 | [AT] | Austria | 2693/89 |
| Dec. 20, 1989 | [AT] | Austria | 2888/89 |
| Jan. 18, 1990 | [AT] | Austria | 105/90 |

[51] Int. Cl.[5] ..... A63C 9/00

[52] U.S. Cl. ..... 280/636

[58] Field of Search ..... 280/618, 620, 633, 636, 280/607, 634

[56] References Cited

U.S. PATENT DOCUMENTS

| | | | |
|---|---|---|---|
| 3,448,990 | 6/1969 | Cubberley et al. | 280/636 |
| 3,743,310 | 7/1973 | Smolka | 280/636 |
| 3,806,144 | 4/1974 | Yans et al. | 280/636 |
| 3,845,965 | 11/1974 | Lipe | 280/636 |
| 3,950,000 | 4/1976 | Sittman | 280/636 |
| 4,004,824 | 1/1977 | Svoboda | 280/636 |
| 4,088,345 | 5/1978 | Korger | 280/636 |
| 4,135,736 | 1/1979 | Druss | 280/626 |
| 4,226,439 | 10/1980 | Kirsch | 280/628 |
| 4,268,062 | 5/1981 | Wittmann | 280/611 |
| 4,951,961 | 8/1990 | Boussemart et al. | 280/626 |

FOREIGN PATENT DOCUMENTS

| | | | |
|---|---|---|---|
| 292528 | 8/1971 | Austria . | |
| 302129 | 1/1972 | Austria . | |
| 311231 | 2/1973 | Austria . | |
| 2500686 | 8/1975 | Fed. Rep. of Germany | 280/636 |
| 757134 | 12/1933 | France | 280/636 |
| 2150314 | 4/1973 | France | 280/636 |
| 2615748 | 12/1988 | France | 280/636 |

*Primary Examiner*—Andres Kashnikow
*Assistant Examiner*—Brian L. Johnson
*Attorney, Agent, or Firm*—Flynn, Thiel, Boutell & Tanis

[57] ABSTRACT

A sole-support device consisting of a support member and a continuous or endless band guided transversely with respect to the longitudinal direction of the ski on the support member. In order to guarantee in such a device that a secure support of the sole of the boot on the band occurs and in order to avoid friction between the sole of the boot and the support member, the band is supported with its upper reach in a groove of the support member, the upper side of a front section of the band lying in a plane that is higher than a horizontal plane of a boundary edge of the front wall of the groove, the upper side of a rear section of the band being aligned with an upper boundary edge of a rear wall of the groove or in a horizontal plane which lies lower than the boundary edge.

43 Claims, 12 Drawing Sheets

SOLE-SUPPORT DEVICE FOR SKI BINDING

FIELD OF THE INVENTION

The invention relates to a sole-support device for use with a ski binding arrangement and beneath the sole of a ski boot.

BACKGROUND OF THE INVENTION

Such a device has already been described in connection with FIG. 5 of Austrian Patent No. 302,129. This device has the disadvantage that the band, Which is thicker than the height of the lateral borders, in which bearing axles are supported, when the skier steps with the ski boot into the binding, is pressed forwardly beyond the front edge by the ski boot and is thus deformed.

A similar disadvantage exists in the design according to U.S. Pat. No. 3,845,965 in which the band is guided only in lateral grooves of a plate-shaped support member. Therefore, lateral borders are missing in this design (see FIGS. 2 and 5).

This is also the case in the device according to Austrian Patent No. 311,231 in which the position of the band is defined in longitudinal direction of the ski only by the bend in the support member.

Finally U.S. Pat. No. 3,448,990 illustrates in FIG. 5 a closed flat cushion in which a lubricant is stored and which is fastened to the upper side of the ski by means of an adhesive. The cushion is in the ball area of the ski boot. The release of the ski boot is supposed to be helped with this cushion during a twisting fall of the skier.

SUMMARY OF THE INVENTION

A sole-support device for ski bindings which has a support member adapted to be fastened to a ski, the support member including a support section on which the weight of a skier is supported. The support section includes structure defining a groove in and extending laterally of the support section. The groove has a pair of spaced upstanding walls. An endless band is guided transversely with respect to a longitudinal direction of the ski on the support section, one reach of the endless band being received in the groove between the upstanding walls. The groove is arranged on an upper side of the support member. The reach consists of a front edge facing a tip of the ski and a rear edge facing a tail of the ski. An upper side of the front edge is higher than the horizontal plane of an upper boundary edge of a front one of the upstanding walls of the groove. An upper side of the rear edge is either aligned with a further upper boundary edge of a rear one of the upstanding walls of the groove or lies in a horizontal plane oriented lower than the further boundary edge.

BRIEF DESCRIPTION OF THE DRAWINGS

Exemplary embodiments of the subject matter of the invention are schematically illustrated in the drawings, in which.

DETAILED DESCRIPTION

Figure 1:
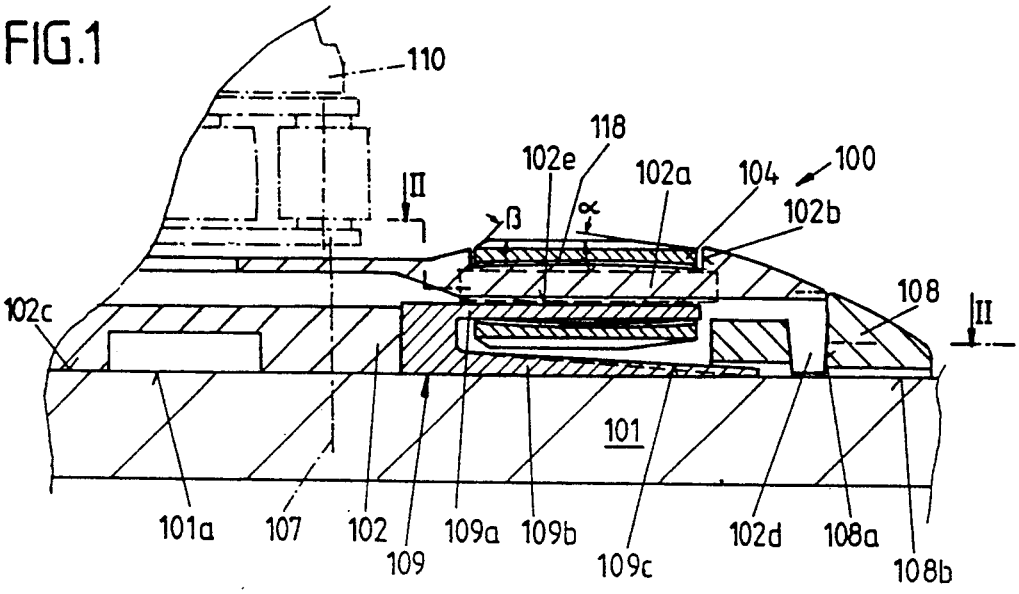
FIG. 1 is a central longitudinal cross-sectional view of a first embodiment.
Figure 2:
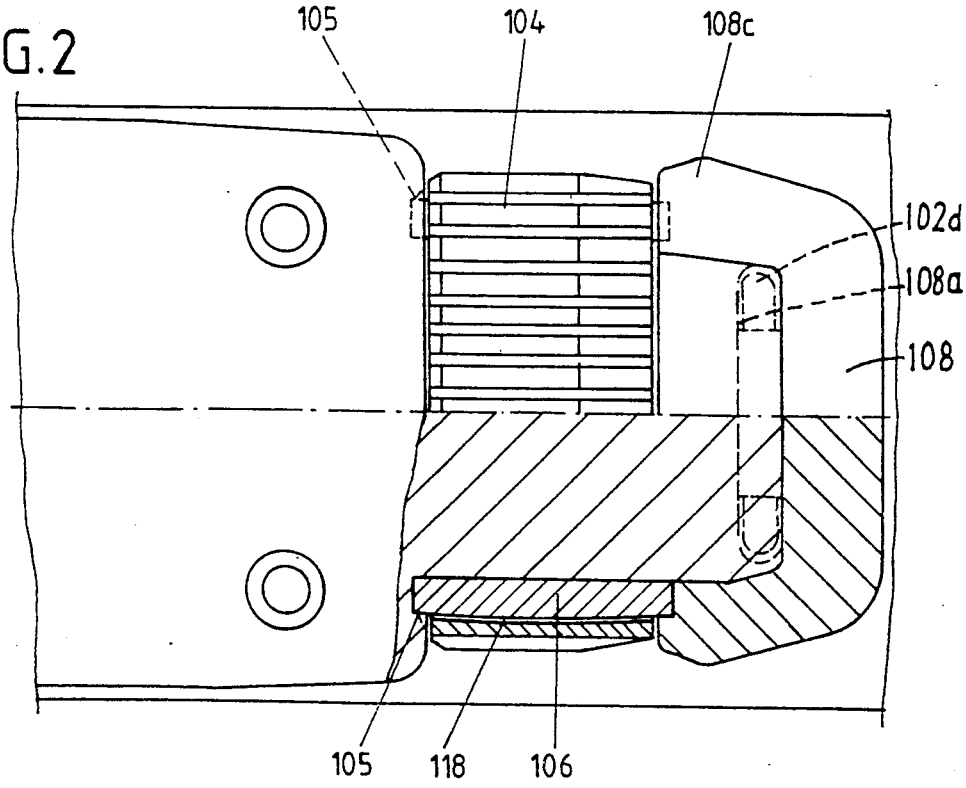
FIG. 2 is an associated top view of the first embodiment, partly cut along the line II—II of FIG. 1.

The sole-support device illustrated in FIGS. 1 and 2 is identified in its entirety by the reference numeral 100. It has a support member 102 fastenable to the upper side 101*a* of a ski 101. A continuous or endless band 104 is supported in a groove 102*b* in a central support section 102*a* of the support member 102, hereinafter also referred to as section.

Figure 5:
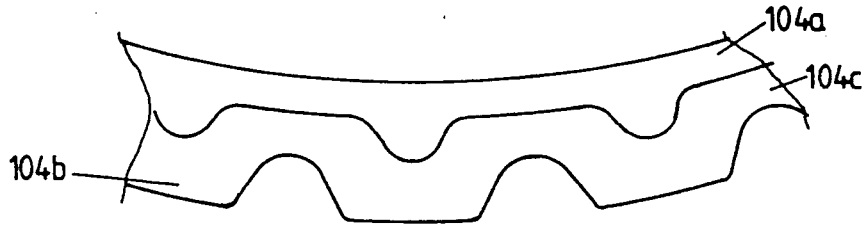
FIG. 5 is a front view of a portion of the band.
Figure 8:
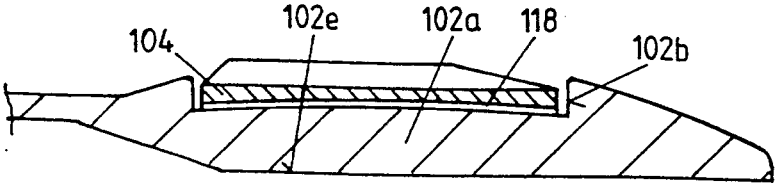
FIG. 8 is an enlarged view of a detail of FIG. 1.

The band 104 (see FIG. 5) consists of a support band 104*a*, not manually expandable and, if necessary, is corrugated on its upper side, and of a rubber band 104*c* fixedly connected to the support band 104*a* and provided with ribs 104*b*. The ribs 104*b* are, on an edge facing the tail end of the ski, inclined at an angle $\alpha$ between 2° and 15°. Whereas, on an opposite edge, namely, the edge facing the tip of the ski, a bevel is formed at an angle $\beta$ lying between 10° and 45°. The bases of the grooves extend thereby between the individual ribs 104*b* in the mounted state of the sole-support device 100 at the front edge of the band 104 in alignment with the upper boundary edge of the associated wall of the groove 102*b*. The upper boundary edge of the associated wall of the groove 102*b* projects slightly, at the rear edge of the band 104, beyond the bases of the grooves between the individual ribs 104*b* or is aligned with the ribs (see FIG. 8). In other words, an endless band is guided transversely with respect to a longitudinal direction of the ski on the support section, one reach of the endless band being received in the groove between the upstanding walls. The groove is arranged on an upper side of the support member. The reach consists of a front edge facing a tip of the ski and a rear edge facing a tail of the ski. An upper side of the front edge is higher than the horizontal plane of an upper boundary edge of a front one of the upstanding walls of the groove. An upper side of the rear edge is either aligned with a further upper boundary edge of a rear one of the upstanding walls of the groove or lies in a horizontal plane oriented lower than the further boundary edge. This prevents the band 104 from being pulled out of the groove 102*b* when the skier steps in with his/her ski boot or during a forward twisting fall.

Two rods 106 of rubber or plastic extending in longitudinal direction of the ski are inserted into bores 105 of the support member 102 in the area of the 180° turning points of the band 104.

The support member 102 is in the area of the support section 102*a* provided with a flat bearing surface 102*c* and is secured by means of screws 107, which are only schematically indicated in FIG. 1, to the upper side 101*a* of the ski 101. The support member 102 has projections 102*d* in the area behind the support section 102*a*. The projections 102*d* are inserted into a slotted hole 108*a* of an end part 108 also provided with a flat bearing surface 108*b*. The end part 108 has also shoulders 108*c*, with which it grips over the free ends of the rods 106. The rods 106 thus can no longer be torn out of the bores 105 of the support member 102 when the end part 108 is mounted.

A groove 102*e*, downwardly and rearwardly open and extending in transverse direction of the device 100, is provided below and in the support section 102*a* of the support member 102. The upper leg 109*a* of an insert member 109 of a hydrophobic and elastic material, for example of silicone rubber or polyethylene, which insert member is U-shaped in cross section, is inserted into the groove 102*e*. However, it is also possible to use this groove 102*e* to fasten a steel band on which the heel holder of the ski binding is anchored and with respect to the front jaw 110 illustrated only by dash-dotted lines in FIG. 1. If the metal band is inserted, the end part 108 is replaced through a suitable cover having an opening therethrough for the metal band. This development is not part of the subject matter of the present invention.

Below the lower strand or reach of the band 104 there is arranged the lower leg 109*b* of the insert member 109 on the upper side 101*a* of the ski between the support member 102 and the end part 108. The upper side 109*c* of the leg 109*b* is formed by a conical surface or by two adjacent surfaces of a pyramid. If ice crystals form between the lower strand of the band 104 and the insert member 109 during transport or during travel, then these are broken during a twisting fall of the skier through the ribs 104*b* on the lower strand of the band 104 and are at the same time removed over the narrow sides of the ski 101.

Figure 3:
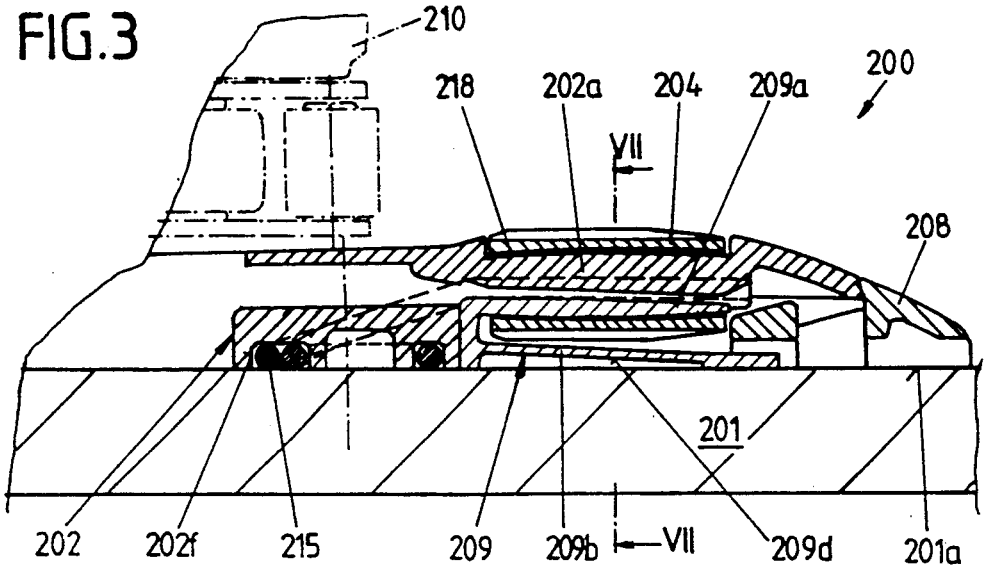
FIGS. 3 and 4, respectively, are a central longitudinal cross-sectional view and a top view of a second embodiment.
Figure 4:
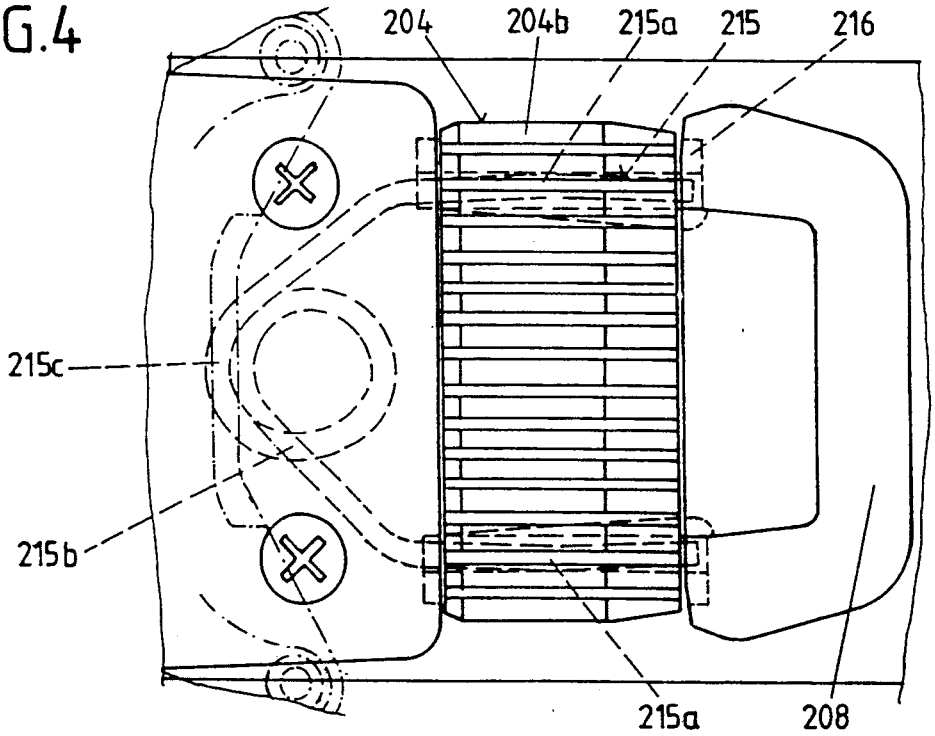

The embodiment of a sole-support device 200 illustrated in FIGS. 3 and 4 is very similar to the first-described one. It differs from it, first, only in the band 204 not being held under tension by two rubber rods, but by the legs 215*a* of a U-shaped torsion spring 215. Pressure elements 216, which are preferably U-shaped in cross section, are mounted on the legs 215*a* of the spring 215. The pressure elements 216 are manufactured of a low friction material and assure an even pressure distribution. The leg 215*b* of the torsion spring 215 has a loop 215*c* and is housed in a recess 202*f* in the support member 202, which recess 202*f* is open toward the upper side 201*a* of the ski. Thus, the leg 215*b* of the torsion spring 215 is held nonmovably with respect to the ski 201.

A further difference between the device 200 and the one described first is that the insert member 209 of plastic, which insert member 209 is approximately U-shaped under the support section 202*a* of the support member 202, rests with its one leg 209*b* on the upper side 201*a* of the ski to form a cavity 209*d*, and other leg 209*a* is received the space between the support section 202*a* and the lower strand of the band 204. This insert member 209 has the task of breaking the ice crystals possibly forming in the space between the lower strand of the band 204 and the leg 209*b* and to move these out of the device through a transverse movement of the band 204 with the help of the ribs 204*b*.

Figure 7:
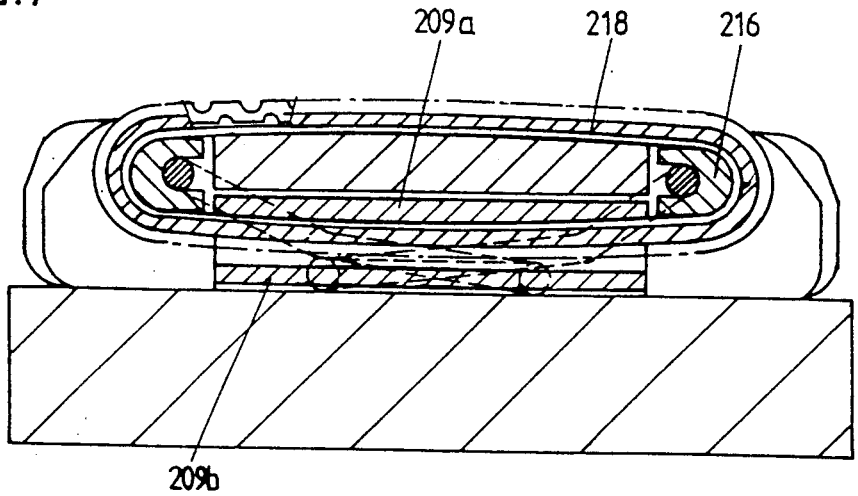
FIG. 7 is a cross-sectional view of the second embodiment taken along the line VII—VII of FIG. 3.

The band 204 rests according to FIG. 3 directly on the support section 202*a* of the support member 202. However, there exists the possibility of interpositioning a strip 218 between the support section 202*a* and the band 204, which strip 218 is manufactured of a low friction material, for example of a polytetrafluoroethylene (see FIG. 7).

Figure 6:
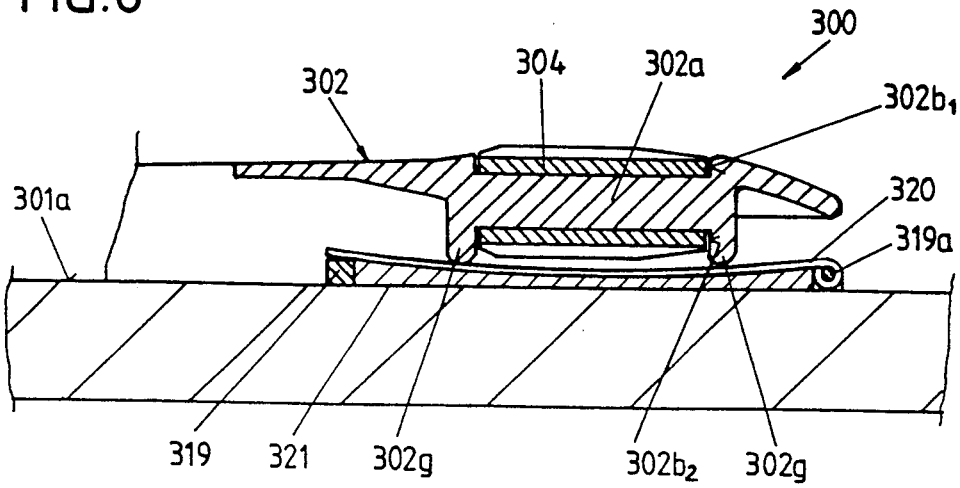
FIG. 6 is a central longitudinal cross-sectional view of a third embodiment.

The sole-support device 300 illustrated in FIG. 6 is distinguished by the band 304 being guided not only with its upper strand, but also with its lower strand in grooves $\mathbf{302}b_1$ and $\mathbf{302}b_2$ of the support member 302. The lower groove $\mathbf{302}b_2$ is thereby defined by two borders 302*g* projecting downwardly from the support section 302*a*.

A rectangular frame 319 is provided below the support section 302*a* on the upper side 301*a* of the ski, the upper side of which frame is covered with a metal foil 320. A foam-material insert 321 is provided inside of the frame 319. The metal foil 320 is secured on one side of the frame 319 by a joint 319*a* and rests loosely on the oppositely lying side of the frame.

The two borders 302*g* rest in the skiing position on the metal foil 320. Since the bearing pressure of the borders 302*g* changes constantly due to the changing load of the skier, a vibrating movement of the metal foil 320 occurs, which breaks the possibly existing ice crystals. Therefore, the ice crystals forming below the lower strand of the band 304 are also in this embodiment broken during skiing and are removed from the space during a lateral release.

Devices can be used for tensioning the band 304 as they have already been described above in connection with FIGS. 1 and 3 or rather 3 and 4 or rather 7.

Figure 9:
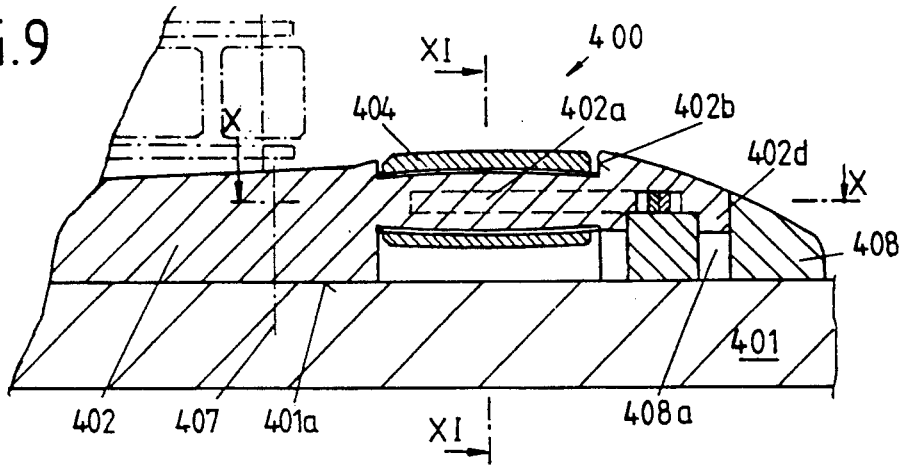
FIG. 9 is a central longitudinal cross-sectional view of a fourth embodiment.
Figure 10:
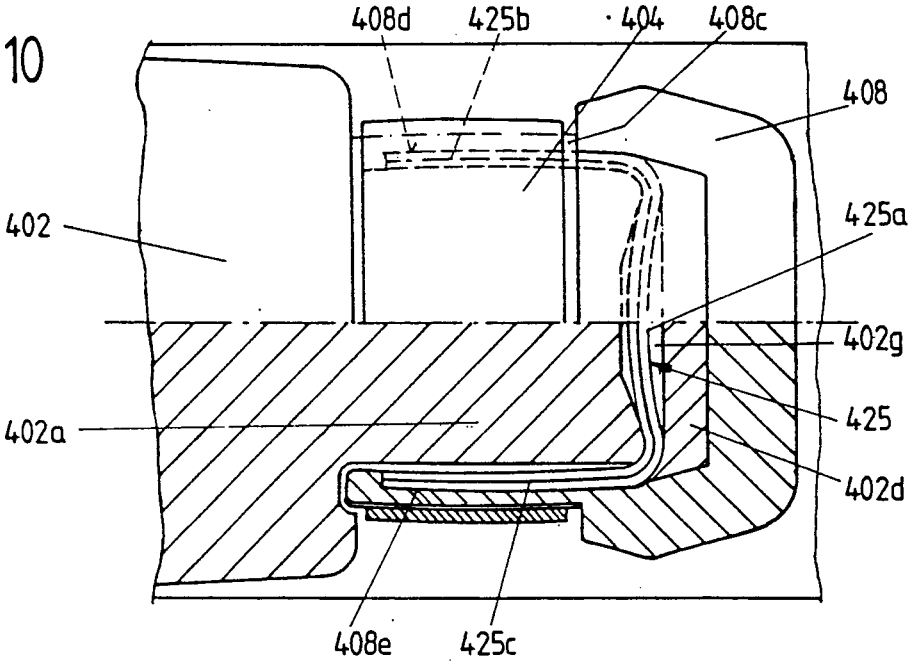
FIG. 10 is a top view of the fourth embodiment partly cut along the line X—X of FIG. 9.
Figure 11:
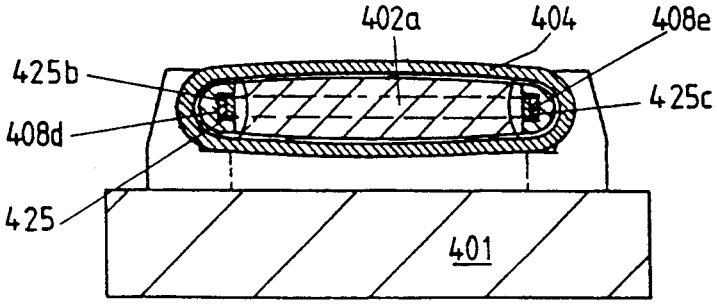
FIG. 11 is a cross-sectional view taken along the line XI—XI of FIG. 9.

The sole-support device illustrated in FIGS. 9–11 is identified in its entirety by the reference numeral 400. It has a support member 402, which can be fastened to the upper side 401*a* of a ski 401 by means of screws 407. A continuous cylindrical band 404 is supported in a groove 402*b* in the center support section 402*a* of the support member 402. The rear end 402*d* of the support member 402 is bent downwardly and is received in a slotted-holelike recess 408*a* of an end part 408. The end part 408 is approximately U-shaped in the top view with the outer surfaces of the two legs 408*c* forming the turning points for the band 404. The legs 408*c* are designed with relatively thin walls and can thus be bent outwardly by small forces.

The support member 402 has near its rear end 402*d* a recess 402*g* enlarged in its central area and extending in a transverse direction. The leg 425*a* of a barlike, U-shaped bimetallic strip 425 acting as a spring is supported with clearance in the recess 402*g* (see FIG. 10). The two legs 425*b* and 425*c* of the bimetallic strip 425 are provided in grooves 408*d*, 408*e* recessed on the insides of the legs 408*c* of the end part 408. Also the legs 425*b*, 425*c* of the bimetallic strip 425 have clearance relative to the two grooves 408*d*, 408*e* of the end part 408.

The band 404 is tensioned with respect to the support section 402*a* in the skiing position so that the edges of the band 404 seal with respect to the support section 402*a* and an undesired penetration of water or dirt into the space between the band 404 and the support section 402*a* is prevented.

However, if the ski 401 is moved into a warm room, for example a storage room, the bimetallic strip 425 is deformed due to the increase in temperature such that the two legs 425*b*, 425*c* pivot toward the support section 402*a* and at the same time lift off from the legs 408*c* of the end part 408. However, this relaxes the band 404.

Figure 12:
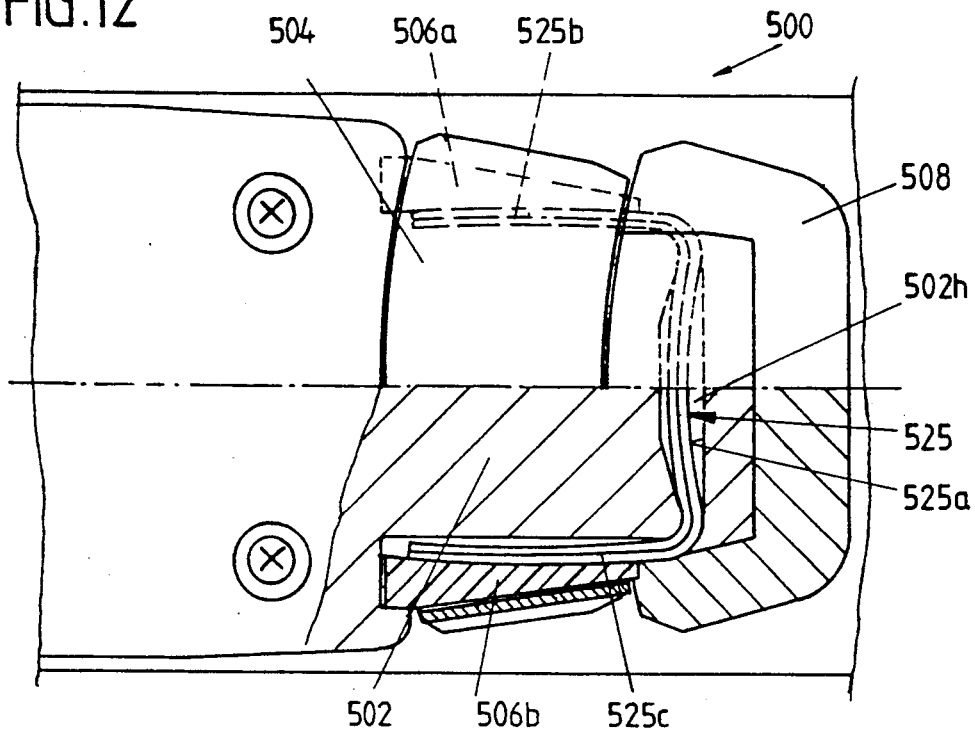
FIG. 12 is a cross-sectional view of a fifth embodiment similar to the one of FIG. 10.
Figure 13A:
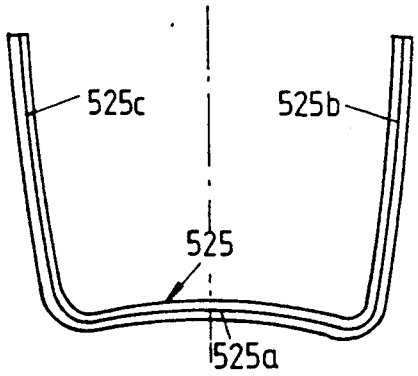
FIGS. 13*a*, 13*b* and 13*c* show, respectively, the bimetallic strip prior to its installation, in its installed state and in its relaxed state.

The fifth embodiment of a sole-support device illustrated in FIG. 12, which sole-support device is identified in its entirety by the reference numeral 500, is very similar to the one aforedescribed. It differs from same in that the band 504 is not cylindrical but conical. The device 500 also has a U-shaped bimetallic strip 525 constructed as a leaf spring with legs 525*b*, 525*c* pointing outwardly after installation (see FIG. 13*a*). The preferably forwardly bent leg 525*a* of this bimetallic strip 525 is housed in a recess 502*h* of a support member 502, which recess 502*h* extends in transverse direction, is open downwardly and is covered by an end part 508. The legs 525*b*, 525*c* of the bimetallic strip 525 extend after installation into the device 500, in their position of use, namely, in the tensioned position of the band 504, parallel with respect to the longitudinal direction of the device 500 and rest on two wedge-shaped intermediate members 506*a*, 506*b*. The intermediate members 506*a*, 506*b* are, therefore, pushed upon by the two legs 525*b*, 525*c* of the bimetallic strip 525 to tension the band 504 in the skiing position of the device 500. The outer surfaces of the wedge-shaped intermediate members 506*a*, 506*b* form thereby the turning points for the band 504.

Figure 13B:
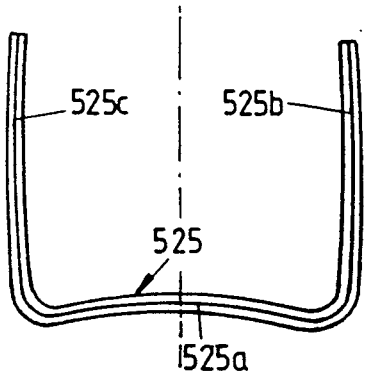

Thus all parts assume in the skiing position the position illustrated in full lines in FIG. 12 (see also FIG. 13*b*).

Figure 13C:
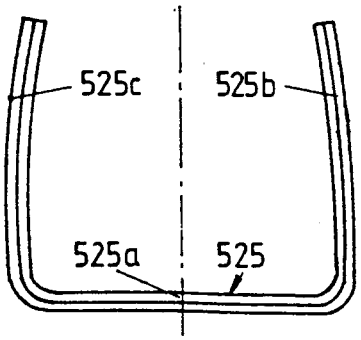

However, if the ski is moved into a warm room, then the two legs 525*b*, 525*c* of the bimetallic strip 525 bend downwardly as shown in FIG. 13*c*, and the band 504 is relieved of the tension applied up to then.

Figure 14:
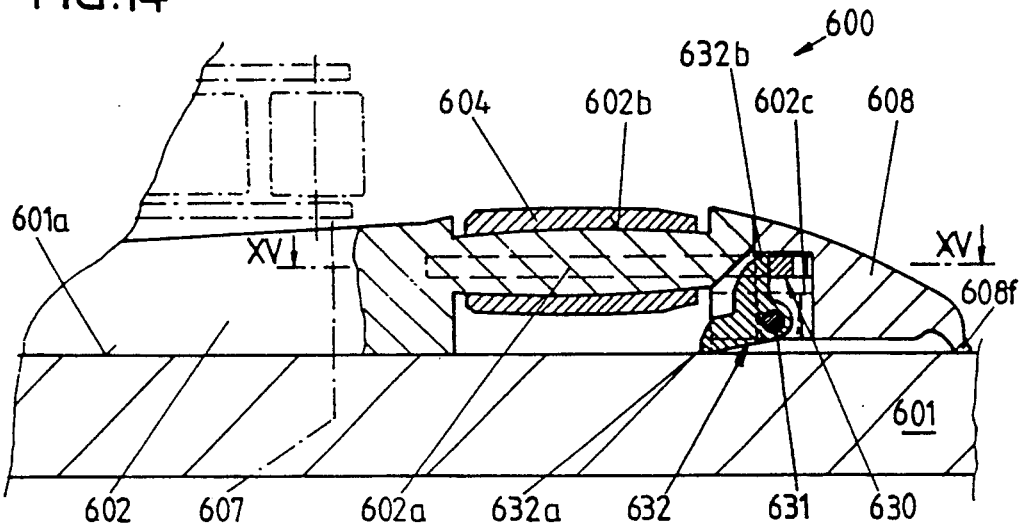
FIG. 14 is a central cross-sectional view of a sixth embodiment with the ski boot not inserted.
Figure 15:
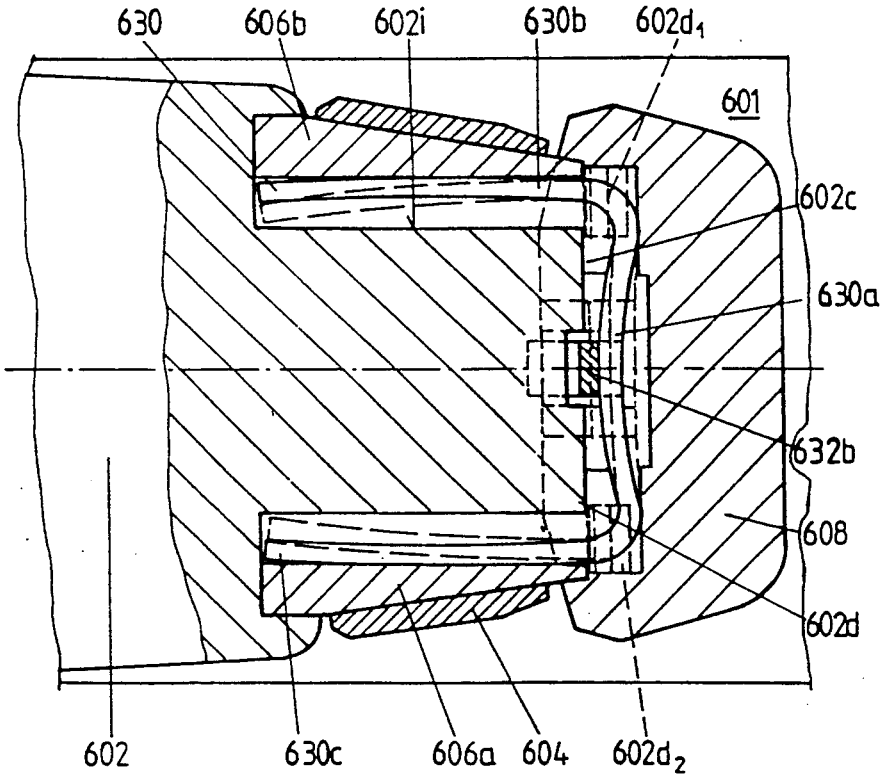
FIG. 15 is a cross-sectional view taken along the line XV—XV of FIG. 14.

The sixth embodiment of a sole-support device illustrated in FIGS. 14 and 15 is identified by the reference numeral 600 in its entirety. It has a support member 602 which can be fastened on the upper side 601*a* of a ski 601, for example, by screws 607. A continuous conical band 604 is supported in a groove 602*b* in the central support section 602*a* of the support member 602. The rear end 602*d* of the support member 602 has two downwardly projecting shoulders $602d_1$ and $602d_2$, the purpose of which will be described in detail hereinafter. The rear end 602*d* of the support member 602 is covered by an end part 608, which is supported only with its rear end 608*f* on the upper side 601*a* of the ski 601. The support section 602*a* of the support member 602 and the end part 608 are manufactured of an elastic material, for example, a plastic. Thus, a pivoting of the support section 602*a* and of the end part 608 toward of the upper side 601*a* of the ski 601 is possible under the influence of the weight of the skier during a frontal fall of the skier.

The support section 602*a* of the support member 602 has a groove 602*i* on three sides, in which groove is supported with clearance a wire or leaf spring 630 which is U-shaped in the top view. The leg 630*a* of the spring 630 is slightly bent in direction of the two legs 630*b*, 630*c*. Wedgelike intermediate members 606*a*, 606*b* are supported on the two legs 630*b*, 630*c*, which intermediate members form the turning points for the continuous conical band 604. The intermediate members 606*a*, 606*b* can be pivoted at least in a given area about the two legs 630*b*, 630*c* of the spring 630.

An axle 631 exists between the two shoulders $602d_1$ and $602d_2$ of the support member 602. A toggle lever 632 is supported on the axle 631. The lower arm 632*a* of the toggle lever 632 rests on the upper side 601*a* of the ski 601 and the other, upper arm 632*b* on the leg 630*a* of the U-shaped spring 630.

All parts assume the position illustrated in full lines in FIG. 14 or 15 in the skiing position of the sole-support device 600. The band 604 is thereby tensioned.

However, if a frontal fall of the skier occurs during skiing, then the support section 602*a* of the support member 602 and the end part 608 is bent toward the upper side 601*a* of the ski 601. The upper arm 632*b* of the toggle lever 632 presses thereby the forwardly bent leg 630*a* of the spring 630 into the elongated position. The two legs 630*b* and 630*c* of the spring 630 are in this manner pivoted inwardly as illustrated by the dashed lines in FIG. 15. The two intermediate members 606*a* and 606*b* can thus lift off from the band 604 and can move toward the vertical longitudinal center plane of the device 600. The band 604 is thus relaxed.

Figure 16:
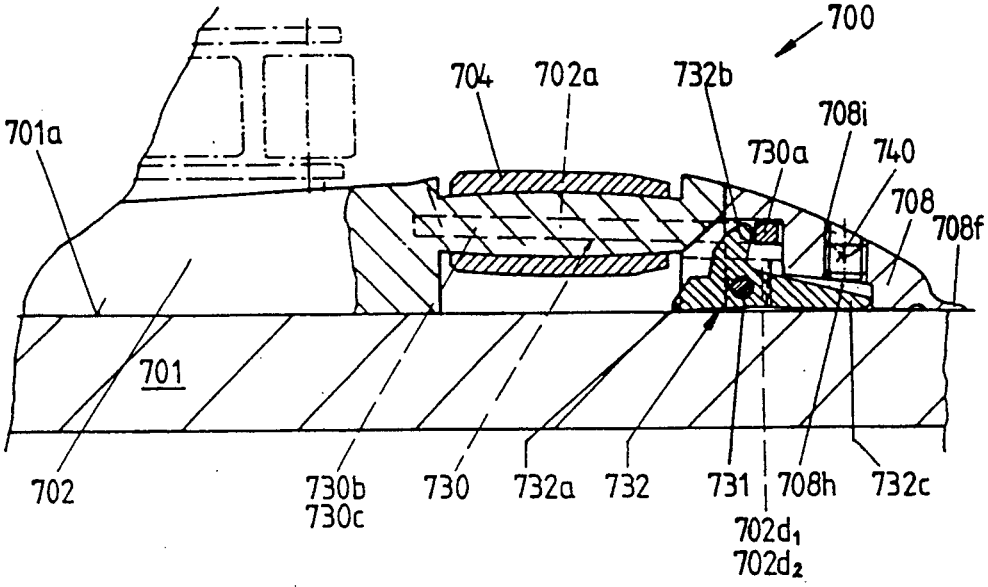
FIGS. 16 and 17 also are central longitudinal cross-sectional views of a seventh embodiment during a frontal fall of the skier and during nonuse of the ski.
Figure 17:
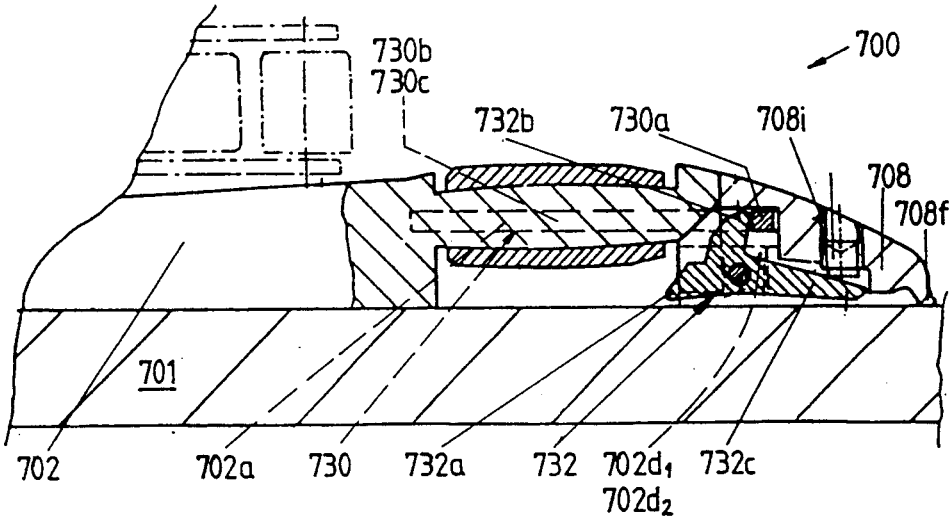

The seventh embodiment 700 of a sole-support device illustrated in FIGS. 16 and 17 differs from the earlier ones in that the toggle lever 732 has a third arm 732*c* which extends in relationship to the axle 731 approximately diametrically with respect to the lever arm 732*a* and is provided in a recess 708*h* of the end part 708. A tapped hole 708*i* extending vertically onto the upper side 701*a* of the ski is provided in the end part 708. A screw 740 is screwed into the tapped hole 708*i*. The axle of the screw 740 intersects the longitudinal axis of the lever arm 732*c*.

Figure 14A:
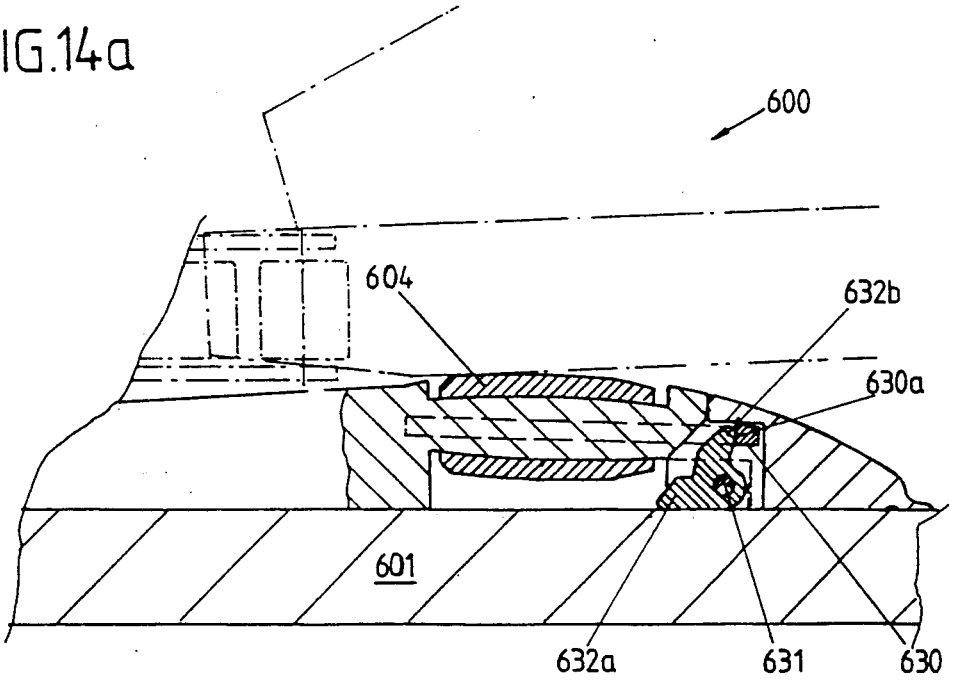
FIG. 14*a* is a central longitudinal cross-sectional view after a frontal fall of the skier.

If the ski 701 is supposed to be used by the skier after being stored, the screw 740 is screwed upwardly in the tapped hole 708*i*, so that the lever arm 732*c* can pivot upwardly within the recess 708*h* of the end part 708. In the case of a frontal fall of the skier, the lever 732 thus urges the bar 730*a* of the spring 730 back causing the two legs 730*b* and 730*c* of the spring 730 to pivot inwardly thus relaxing the band 704, as this has already been discussed in connection with the earlier described exemplary embodiment (see FIG. 14*a*).

However, if the screw 740 is tightened or moved downwardly in the tapped hole, the lever arm 732*c* is pressed downwardly (see FIG. 17), and the toggle lever 732 is pivoted. However, this has the result that the lever arm 732*b* of the toggle lever 732 presses the leg 730*a* of the spring 730 back so that also the band 704 can relax.

Figure 18:
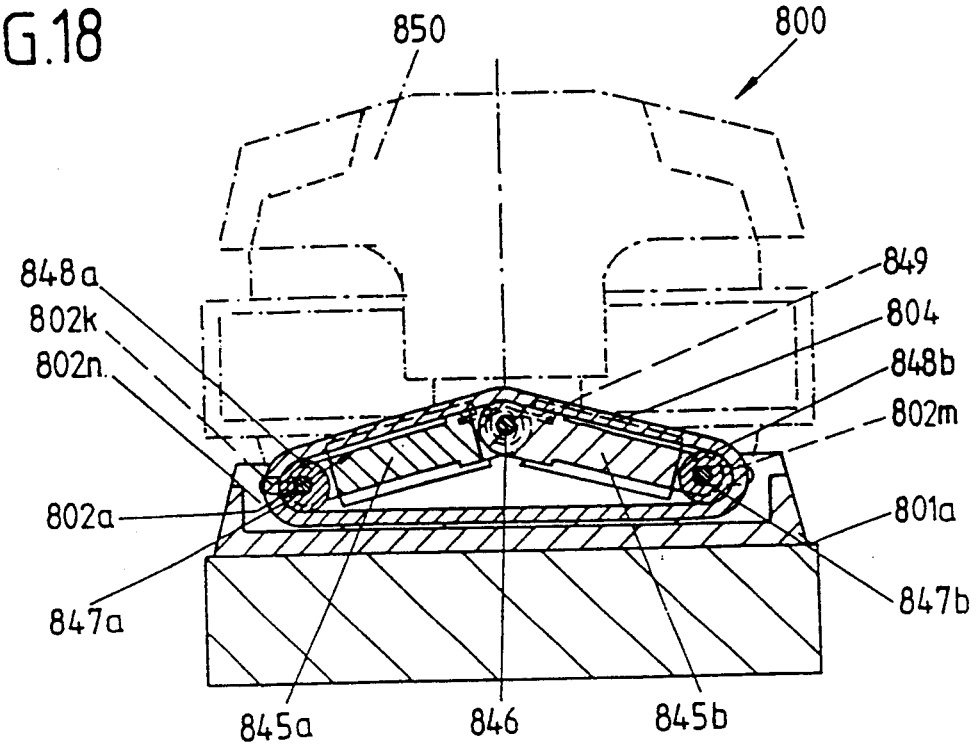
FIG. 18 is a cross-sectional view taken along the line XVIII—XVIII of FIG. 19 of an eighth embodiment in the rest position.
Figure 19:
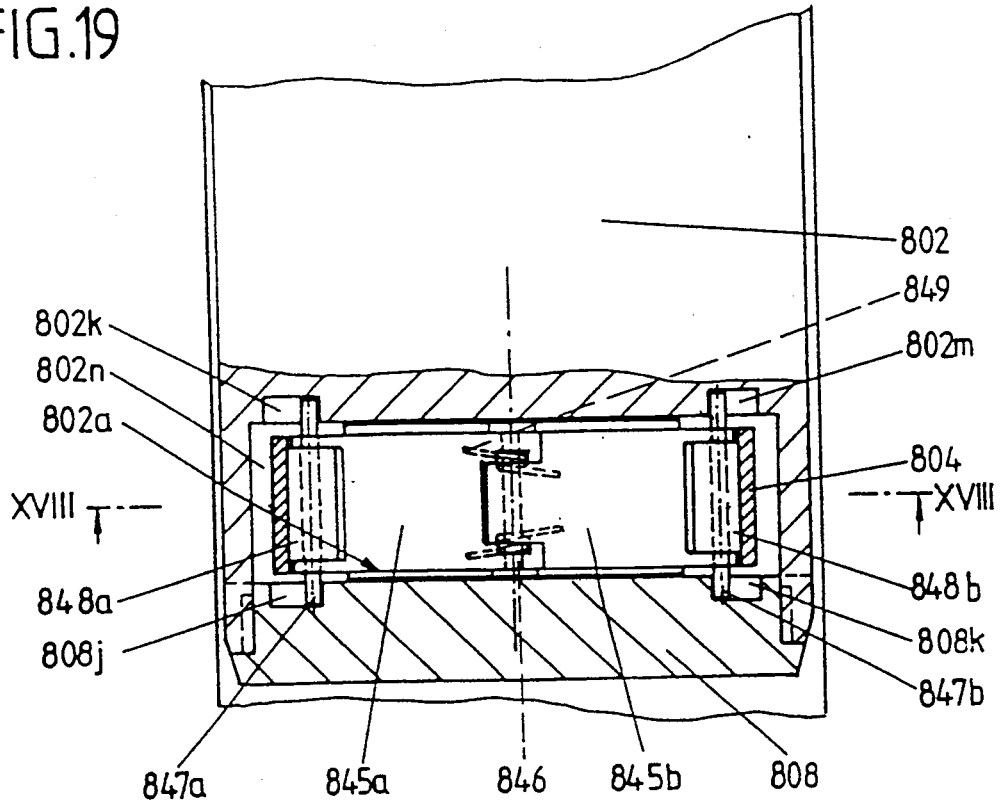
FIG. 19 is a top view of FIG. 18, the band being cut away to facilitate an unobstructed view of the toggle joint.
Figure 20:
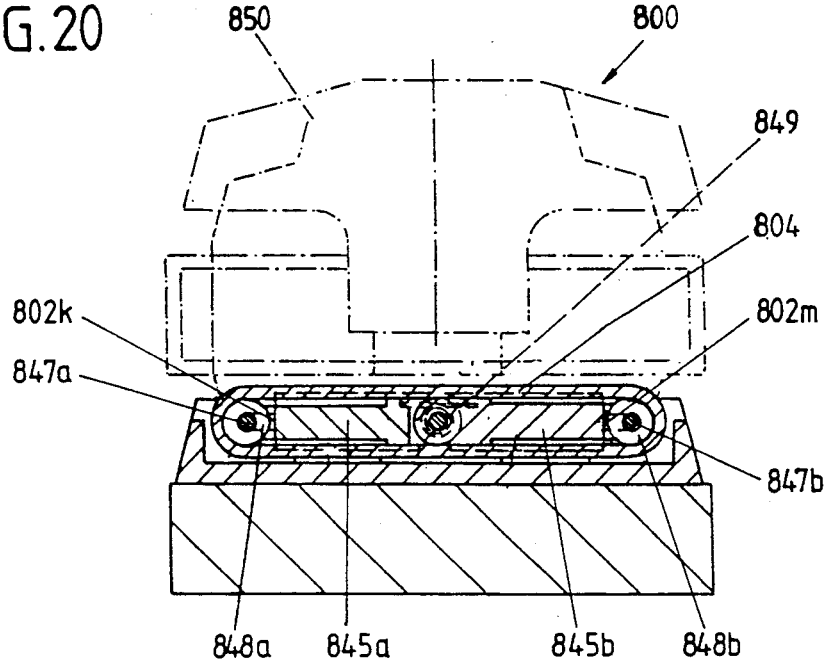
FIG. 20 is a cross-sectional view corresponding with FIG. 18 of the sole-support device in the skiing position.

The eighth embodiment of a device 800 illustrated in FIGS. 18–20 is distinguished by the support section 802*a* of the support member 802 not being rigidly connected to the support member, but is formed by two levers 845*a*, 845*b* independent from the support member 802, which levers are connected like a toggle joint by means of an axle 846. A strong tensioning of the band 804 in the skiing position can be achieved with relatively small forces due to the toggle-lever action. Each of the two levers 845*a*, 845*b* has at its free end a roller 848*a* or rather 848*b* supported on an axle 847*a* or rather 847*b*, which rollers guide the band 804. Two torsion springs 849 are supported on the axle 846 connecting the two levers 845*a* and 845*b*. The torsion springs 849 pivotally urge the two levers 845*a* and 845*b* toward one another.

The axles 847*a* and 847*b* of the two rollers 848*a* and 848*b* are extended beyond their bearing points in the two levers 845*a* and 845*b* and are supported in slotted holes 802*k*, 802*m* in the support member 802 or rather in slotted holes 808*j*, 808*k* of the end part 808. The slotted holes 802*k*, 802*m* or rather 808*j*, 808*k* parallel with respect to the upper side 801*a* of the ski. The two levers 845*a*, 845*b* are stored in an upwardly open trough-shaped recess 802*n* of the support member 802, which is closed off rearwardly by the end part 808.

The individual elements of the sole-support device 800 assume in the rest position the position illustrated in FIGS. 18 and 19, in which position the axles 847*a* and 847*b* of the two rollers 848*a* and 848*b*, under the influence of the two torsion springs 849, rest on the inner ends of the associated slotted holes 802*k*, 802*m* and 808*j*, 808*k*.

When the skier steps with his ski boot into the front jaw 850, which is only indicated by dash-dotted lines in FIGS. 18 and 20, the ski boot presses the two levers 845*a*, 845*b* into their elongated position (see FIG. 20). The band 804 is tensioned in this position such that during the skiing its two edges rest closely on the upper side of the two levers 845*a*, 845*b*. The axles 847*a*, 847*b* of the two rollers 848*a*, 848*b*, which due to the pressure of the ski boot were moved outwardly, are in the end area of the slotted holes 802*k*, 802*m*, 808*j*, 808*k* without, however, striking the outer ends.

As soon as the ski boot has again left the front jaw 850, the two levers 845*a*, 845*b* are again pivoted inwardly under the influence of the two torsion springs 849 until they have reached the position illustrated in FIG. 18.

Figure 21:
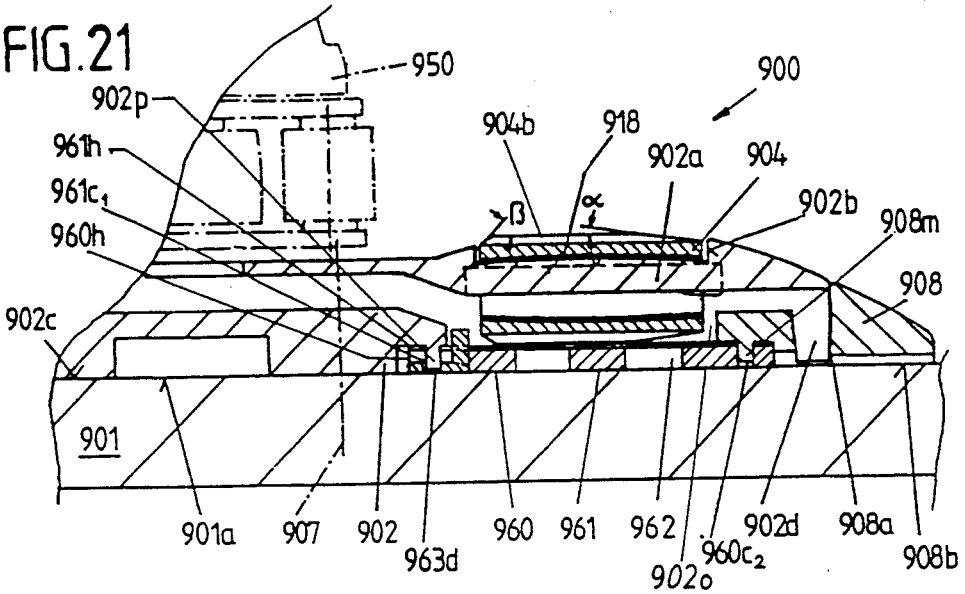
FIG. 21 is a central longitudinal cross-sectional view of a ninth embodiment.
Figure 22:
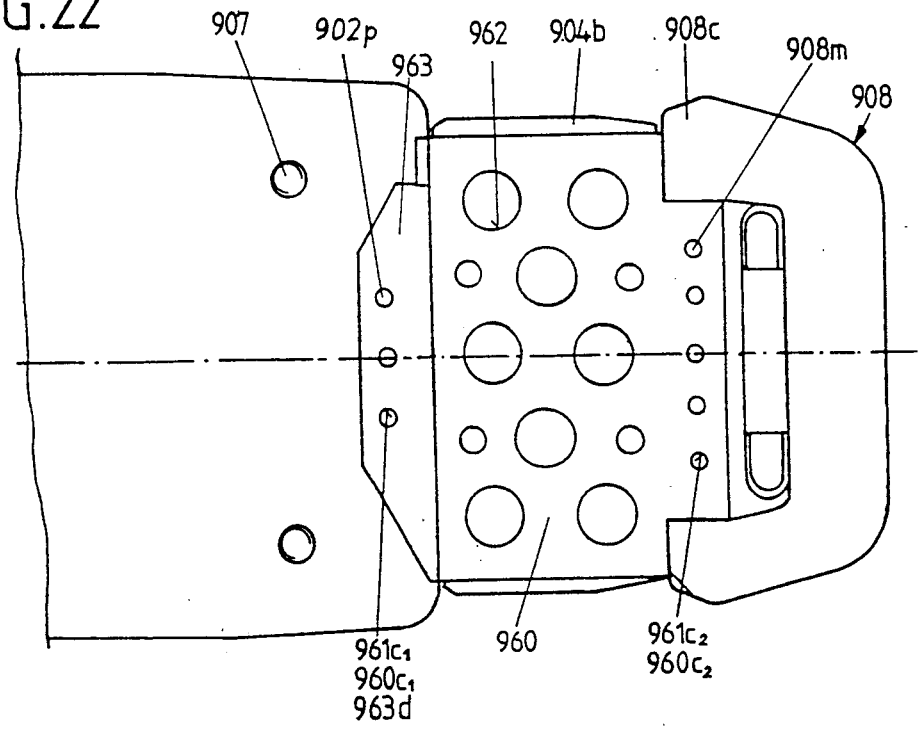
FIG. 22 is a bottom view of the same.

The sole-support device illustrated in FIGS. 21 and 22 is identified in its entirety by the reference numeral 900. It has a support member 902, which can be secured on the upper side 901*a* of a ski 901 and in the central support section 902*a* of which there is supported a continuous cylindrical band 904 in a groove 902*b*.

The band 904 has ribs 904*b* inclined at an angle $\alpha$ between 2° and 15° on the edge facing the tail end of the ski. Whereas on the opposite edge facing the tip of the ski, a bevel is formed at an angle $\beta$ lying between 10° and 45°. A strip 918 of polytetrafluoroethylene exists between the band 904 and the support section 902*a*. The front jaw, identified here by dash-dotted lines, has the reference numeral 950.

The support member 902 is provided with a flat bearing surface 902*c* in the area in front of the support section 902*a* and is fastened by means of screws 907, which are only schematically indicated in FIG. 21, on the upper side 901*a* of the ski 901. The support member 902 has projections 902*d* in the area behind the support section 902*a*. The projections 902*d* are inserted in a slotted hole 908*a* of an end part 908, which also has a flat bearing surface 908*b*. The end part 908 has furthermore shoulders 908*c* laterally gripping around the support section 902*a*.

A recess 902*o*, opening upwardly and to both sides, is provided below the support section 902*a* of the support member 902 and in the support section. The bottom portion of the recess 902*o* is closed off by a plate 960 covered with a foil 961 of polytetrafluoroethylene. The plate 960 consists in the illustrated exemplary embodiment of an elastic material having a hardness of up to a maximum of 30 shore A. It has recesses 962 increasing the flexibility of the plate 960. However, there exists also the possibility of limiting the hardness of the plate to 15 shore A at a maximum. The flexibility of the plate 960 is in this case so great that recesses do not need to be provided.

The plate 960 and the foil 961 have holes 960*c*$_1$, 960*c*$_2$, 961*c*$_1$, 961*c*$_2$ adjacent their two edges, with which holes they can be mounted onto the pegs 902*p* of the support member 902 and onto the pegs 908*m* of the end part 908, and on which the plate 960 and the foil 961 are held by friction. The plate 960 and the foil 961 are held at one end by means of tabs 960*h*, 961*h*, which have holes 960*c*$_1$, 961*c*$_1$, in slots 963*f* of a holder 963 rectangular in cross section. The horizontal leg of the holder 963 has also a number of holes 963*d*. The two slots 963*f* are arranged symmetrically with respect to the vertical longitudinal center plane of the device 900.

The foil 961 and the plate 960 easily make it possible to remove those ice crystals which form during skiing between the lower strand of the band 904 and the foil 961, during a fall of the skier from the device.

Figure 26:
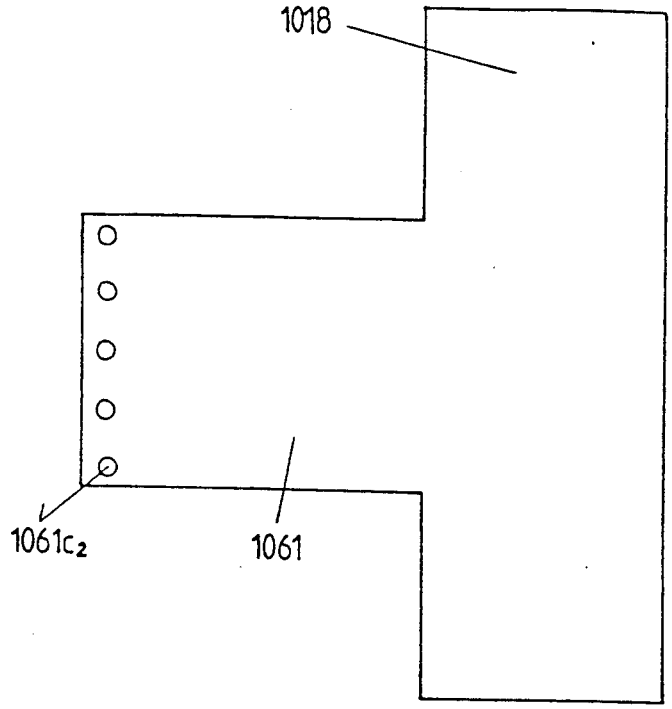
FIG. 26 is a top view of a tenth embodiment of a blank of a piece consisting of foil and strip, prior to the ends of the strip having been welded together.
Figure 27:
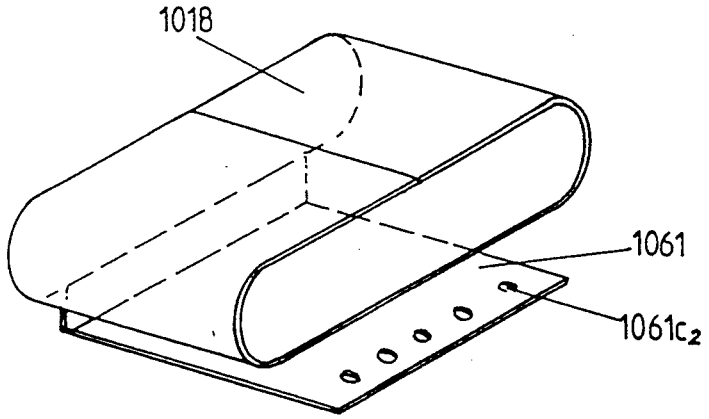
FIG. 27 is a perspective view of the same piece, however, after the two ends of the strip have been welded together.
Figure 28:
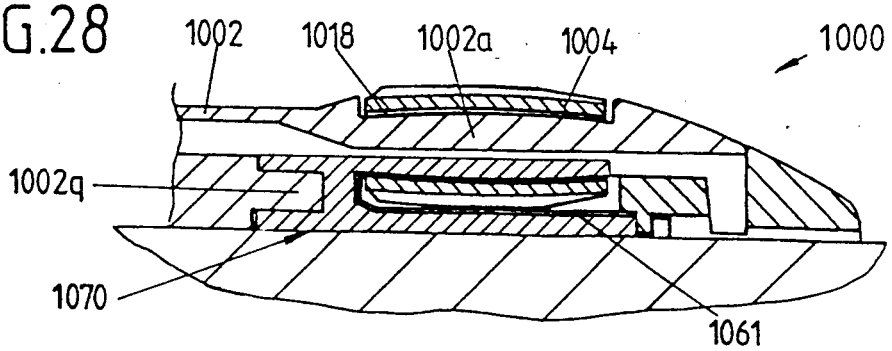
FIG. 28 is a central longitudinal cross-sectional view of the piece in the state in which it is installed into the sole-support device.

The tenth embodiment 1000 illustrated in FIGS. 26 to 28, of which only one detail is illustrated, is distinguished by the strip 1018 of polytetrafluoroethylene arranged between the band 1004 and the support section 1002*a* of the support member 1002 being manufactured in one piece together with the foil 1061. The piece has as a blank which is approximately "T" shaped in the top view. The two ends of the strip 1018 are first welded together in this piece. Then the stem of the "T", which has a number of holes 1061*c*$_2$ at its end, is bent at 180°, so that the end of the stem extends parallel to those sections of the strip 1018 forming the bearing areas for the two strands or reaches of the band 1004.

The piece consisting of the foil 1061 and of the strip 1018 is thereafter sprayed all around with an elastic material, for example, foam rubber, natural rubber or the like, forming a member 1070. The member 1070 has—viewed in cross section—approximately a H shape. The member 1070 is thereafter moved with its two front legs onto a shoulder 1002*q* of the support member 1002.

Figure 29:
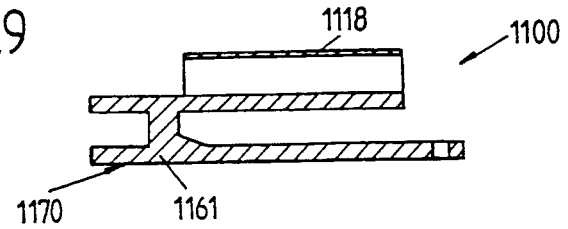
FIG. 29 is also a central longitudinal cross-sectional view of a detail of an eleventh embodiment of the device of the invention.
Figure 23:
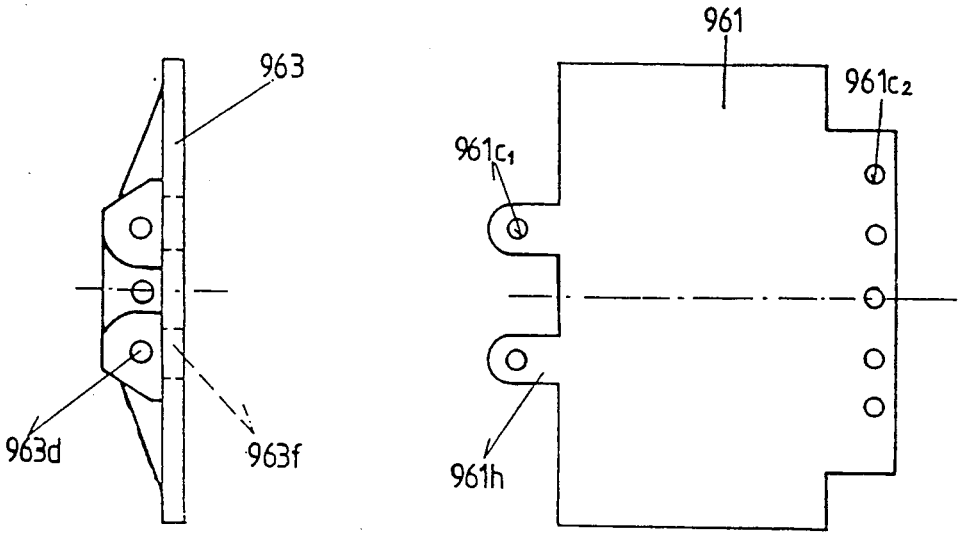
FIG. 23 shows the plate and the holder in a pulled-apart state.
Figure 24:
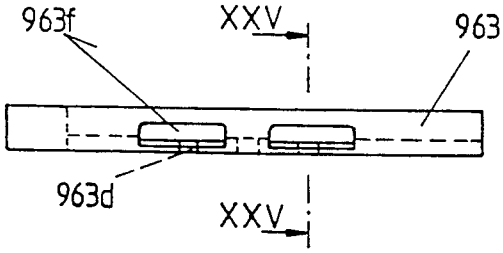
FIG. 24 shows the holder in direction of the arrow XXIV in FIG. 25.
Figure 25:
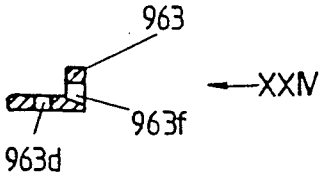
FIG. 25 is a cross-sectional view taken along the line XXV—XXV of FIG. 24.

The eleventh embodiment 1100 illustrated in FIG. 29 is distinguished by the piece consisting of the foil 1161 and of the strip 1118 forming one single structural part with the member 1170. The member 1170 is thereby also foamed of an elastic material, for example of polytetrafluoroethylene. The assembly of the device is simplified by this one-piece construction of the parts 1161, 1118, and 1170.

The invention is not to be limited to the illustrated and above-described embodiments. Rather many different modifications of these are possible without departing from the scope of the invention. For example, it is also possible to utilize other clamping devices like wedges or the like to tension the band. Furthermore it would be conceivable in the exemplary embodiment according to FIGS. 9–11 to support the cylindrical band at its turning points through intermediate members which are independent from the end part and therefore can pivot about the legs of the bimetallic strip. Furthermore, it would be possible in the exemplary embodiment according to FIGS. 14, 14*a* and 15 to construct the support section of the support member rigidly, however, the transverse axle for the toggle lever would be manufactured of a spring-steel wire. The end part of an elastic material would in this case have to be provided with at least one shoulder, which during a frontal fall of the skier bends the transverse axle for the toggle lever downwardly. In the exemplary embodiment according to FIGS. 18 to 20 it would be possible to extend in place of the roller axles the axle in the toggle joint forwardly and to guide this extension in a vertical guide groove of the support member. The two levers would through this measure also be centered in the pressed-down state. It would be conceivable in the exemplary embodiment according to FIGS. 28 and 29 to fasten the shoulder for fastening the member consisting of the strip and of the foil and being H-shaped in cross section instead of on a shoulder of the support member on a shoulder of the end part. Finally, it would be possible in the embodiment according to FIGS. 21 and 28 to glue the foil to the plate, or it would be possible to apply a layer onto the plate during a separate manufacturing operation.

The embodiments of the invention in which an exclusive property or privilege is claimed are defined as follows:

1. In a sole-support device for ski bindings comprising a support member adapted to be fastened to a ski, said support member including a support section on which the weight of a skier is supported, said support section including means defining a groove in and extending laterally of said support section, said groove having a pair of spaced upstanding walls, an endless band guided transversely with respect to a longitudinal direction of the ski on said support section, one reach of said endless band being received in said groove between said upstanding walls and adapted to support a ski boot directly thereon, the improvement wherein said groove is provided on an upper side of said support member, wherein said reach consists of a front edge facing a tip of the ski and a rear edge facing a tail of the ski, wherein an upper side of said front edge of said reach is higher than a horizontal plane of an upper boundary edge of a front one of said upstanding walls of said groove, and wherein an upper side of said rear edge of said reach is at least one of aligned with a horizontal plane of a further upper boundary edge of a rear one of said upstanding walls of said groove and lies in a horizontal plane oriented lower than said further boundary edge.

2. The device according to claim 1, wherein an outwardly facing surface of said endless band has plural ribs thereon extending in a longitudinal direction of the ski.

3. The device according to claim 2, wherein said band is substantially rectangular n cross section, said ribs adjacent said rear edge being inclined at an angle $\alpha$ between 2° and 15°, said ribs adjacent said front edge being inclined at an angle $\beta$ between 10° and 45°.

4. The device according to claim 1, wherein a pair of elastic rods having respective rear ends are inserted into means defining bores in said support member adjacent each laterally spaced turning point of said band, said elastic rods extending in a direction generally parallel to the longitudinal direction of the ski.

5. The device according to claim 4, wherein said support member has a flat bearing surface in an area in front of said support section and has projections to the rear of said support section adapted to engage a separate end part.

6. The device according to claim 5, wherein said projections are received into a slotted hole which is provided in said end part, said end part having shoulders with means thereon for gripping over the rear ends of said two rods.

7. The device according to claim 1, wherein in said support member below said support section there is provided a downwardly and rearwardly open further groove extending in longitudinal direction of said device, into which further groove is inserted an upper leg of a U-shaped insert member made of a nonabsorbent and elastic material.

8. The device according to claim 1, wherein adjacent turning points of said band there are arranged legs of a U-shaped torsion spring, a loop of said torsion spring being received in a recess in said support member.

9. The device according to claim 7, wherein below a lower reach of said band on an upper side of the ski between said support member and said end part there is arranged a lower leg of said insert member, with the upper side of said lower leg being formed by at least one of a conical surface and two adjacent surfaces of a pyramid.

10. The device according to claim 7, wherein said insert member is made of plastic and is generally U-shaped in cross section, is arranged below said support section of said support member, and rests with a lower leg on an upper side of the ski, an upper leg is received in a space between said support section and a lower strand of said band.

11. The device according to claim 8, wherein pressure elements U-shaped in cross section are mounted onto the legs of said torsion spring, which pressure elements are made of a low friction material and form the turning points for said band.

12. The device according to claim 1, wherein said support section of said support member has in an underside a groove for a lower reach of said band defined by two borders, and wherein below said support section on an upper side of the ski there is provided a foam-material insert covered by a metal foil, on which foam-material insert rests the two borders.

13. The device according to claim 12, wherein said foam-material insert is enclosed by a rectangular frame, to the one side of which, which side extends in the longitudinal direction of the ski, is hinged said metal foil, a free end of which is supported on an oppositely lying side of the frame.

14. The device according to claim 1, wherein said band consists of an endless nonelastic support band and an elastic band fixedly connected to an outer periphery of said support band.

15. The device according to claim 14, wherein said outer periphery of said support band is corrugated.

16. The device according to claim 1, including a U-shaped bimetallic strip forming a spring, a bight portion thereof being stored in a recess of said support member and which, depending on an outside temperature, maintains said band in a generally tensioned state.

17. The device according to claim 16, wherein said recess for receiving a leg of said bi-metallic strip extends in transverse direction of said support section of said support member and is open in a downwardly direction.

18. The device according to claim 16, wherein said support section of said support member is supported on a U-shaped end part, and wherein said end part has on a leg at least one recess, into which recess is received a bent rear end of said support member.

19. The device according to claim 8, wherein two legs of said end part extend outside of the two legs of said bimetallic strip, and wherein outer surfaces of said two legs of said end part form the turning points for said band.

20. The device according to claim 16, wherein at least one of said support member and said end part is protected by a reflecting layer against radiation and heating up caused by the sun.

21. The device according to claim 1, including at least one of a U-shaped wire spring and a leaf spring supported with clearance in a groove on three sides of said support section of said support member, a central leg of said spring being under the influence of at least one toggle lever having a pair of arms, which during a frontal fall of the skier presses onto the central leg of the U-shaped spring and thus lifts a pair of outer legs of said spring off from said band.

22. The device according to claim 21, wherein said support section of said support member is flexible, and wherein said toggle lever is supported on a transverse axle between two shoulders provided on said support section.

23. The device according to claim 21, wherein said central leg of said spring and said toggle lever are covered by a deformable end part which is attached to at least one of said support member and said support section.

24. The device according to claim 23, wherein said deformable end part is supported only at a rear end on an upper side of the ski.

25. The device according to claim 21, including an adjusting screw provided in a tapped hole on said deformable end part, which in a screwed-in state holds said central leg of said spring in a pressed-through position and thus in a position in which said two outer legs of said spring are pivoted inwardly.

26. The device according to claim 25, wherein a third arm is attached to said toggle lever, which third arm is generally diametrically opposite a first arm with respect to a transverse axle and with which third arm is associated said adjusting screw which is supported in said tapped hole in said end part.

27. The device according to claim 1, wherein said support section of said support member is formed by two relatively movable levers connected with one another by an axle to define a toggle joint.

28. The device according to claim 27, wherein two relatively movable levers have rollers at their free ends, which rollers guide engage said band at turning points thereon.

29. The device according to claim 27, wherein said two relatively movable levers are under the influence of at least one spring which urges said levers toward one another.

30. The device according to claim 28, wherein axles of said two rollers extend beyond bearing points in said two levers and are supported in slotted holes recessed in at least one of said support member and said end part and which extend parallel with respect to an upper side of the ski.

31. The device according to claim 27, wherein said two relatively movable levers are stored in a generally trough-shaped recess in said support member.

32. The device according to claim 1, wherein said support section is spaced above said support member, and wherein on said support member below said support section there is provided a recess which is open in an upward direction and to both lateral sides of the ski and in which a lower reach of said band is guided, said recess being closed off at a bottom thereof by a foil of a material having good low friction properties.

33. The device according to claim 32, wherein said foil is made of polytetrafluoroethylene.

34. The device according to claim 32, wherein said foil is arranged on a plate made of an elastic material.

35. The device according to claim 34, wherein said plate is made of a material having a shore hardness A of up to 15 at a maximum.

36. The device according to claim 34, wherein said plate is made of a material having a shore hardness A of up to 30 at a maximum and has plural recesses therein.

37. The device according to claim 32, wherein said plate and said foil have holes at both of their ends, said holes receiving pegs on at least one of said support member and said end part.

38. The device according to claim 37, wherein a holder is provided which has a horizontally extending leg with holes therein and a vertical leg having at least two slots, and wherein both said plate and said foil each have two tabs, which tabs each have a hole and which can be guided into said slots of said holder.

39. The device according to claim 32, wherein said foil is manufactured in one piece having a T-shape, a cross part of the T being joined end-to-end to define a support for said band.

40. The device according to claim 39, wherein opposite ends of said cross part are welded together.

41. The device according to claim 40, wherein at least said cross part has an elastic material member formed thereon.

42. The device according to claim 41, wherein said member has generally an H-shape, two legs of said H-shaped member extending forwardly and onto a shoulder on said support member.

43. The device according to claim 39, wherein said cross part and said H-shape member form a single structural part.

* * * * *

UNITED STATES PATENT AND TRADEMARK OFFICE

CERTIFICATE OF CORRECTION

PATENT NO. : 5 092 622

DATED : March 3, 1992

INVENTOR(S) : Helmut WLADAR et al.

It is certified that error appears in the above-identified patent and that said Letters Patent is hereby corrected as shown below:

Col. 10, line 8; change "n" to ---in---.

Col. 11, line 15; change "bi-metallic" to ---bimetallic---.

line 17; change "downwardly" to ---downward---.

line 23; change "claim 8" to ---claim 18---.

Signed and Sealed this

Twenty-first Day of September, 1993

Bruce Lehman

*Attest:*

BRUCE LEHMAN

*Attesting Officer*

*Commissioner of Patents and Trademarks*